US005772726A

United States Patent [19]

Woods et al.

[11] Patent Number: 5,772,726

[45] Date of Patent: Jun. 30, 1998

[54] METHOD OF SEPARATING VANADIUM FROM ASH

[75] Inventors: Herbert P. Woods, Exton; Lionel M. Gillston, Norristown, both of Pa.

[73] Assignee: Roy F. Weston, Inc., West Chester, Pa.

[21] Appl. No.: 727,124

[22] Filed: Oct. 8, 1996

[51] Int. Cl.[6] ..... C22B 34/22; C22C 33/00

[52] U.S. Cl. ..... 75/10.22; 420/590; 75/622

[58] Field of Search ..... 75/10.22, 622; 420/590

[56] References Cited

U.S. PATENT DOCUMENTS

| | | | |
|---|---|---|---|
| 4,519,835 | 5/1985 | Gauvin et al. | 75/10.22 |
| 5,496,392 | 3/1996 | Sims et al. | 75/414 |

OTHER PUBLICATIONS

Howard et al, "Vanadium Distribution in Melts Intermediate to Ferroalloy Production from Vandium Slag" *Metallurgical and Materials Tranasactions B,* vol. 25B pp. 27–32 Feb. 1994.

*Primary Examiner*—Melvyn Andrews
*Attorney, Agent, or Firm*—Miller & Christenbury

[57] ABSTRACT

A method of separating vanadium from waste ash including generating a high temperature thermal plasma; contacting the waste ash with the high temperature thermal plasma in the presence of oxygen, thereby forming a layer of iron from iron and iron components contained within the waste ash and a layer of slag on top of the iron layer; causing vanadium contained within the waste ash to collect at an upper surface of the layer of iron and then react with the oxygen to form vanadium oxides and combine with the layer of slag; removing most of, but not all of, the layer of iron; stirring the layer of slag without addition of more of the oxygen; adding aluminum and carbon to the layer of slag; reducing or terminating power supplied to generate the high temperature thermal plasma; causing the aluminum to replace the vanadium in the vanadium oxides and causing the carbon to remove oxygen from iron oxides in the remaining portion of the layer of iron, whereby vanadium and iron combine to form a ferro-vanadium alloy.

20 Claims, 1 Drawing Sheet

METHOD OF SEPARATING VANADIUM FROM ASH

FIELD OF THE INVENTION

This invention relates to recovery of metals from ash, particularly to recovery of vanadium and nickel from incinerator type ashes.

BACKGROUND OF THE INVENTION

A number of incineration and industrial production processes produce huge quantities of ash. As examples, use of petroleum coke results in large quantities of petroleum coke ash. Combustion of fuel oils results in fuel oil ash. Further, combustion of bituminous slurries results in production of ashes.

The above-described ashes, as well as others not specifically described, contain significant quantities of metals. Among these metals are vanadium and nickel. Certain of the ashes contain relatively high percentages of these metals such that disposal of the ashes would be highly wasteful. For example, petroleum coke ash often contains about 20% vanadium metal and 6% nickel metal. Similarly, many of the bituminous ashes contain vanadium and nickel in quantities of about 30% vanadium (in oxide form) and 10% nickel (in oxide form). Thus, there is a large incentive to effectively and efficiently separate these valuable metals from material that is otherwise typically destined for disposal.

There have been attempts in the past to separate metallic vanadium from vanadium containing slags. For example, Howard et al, *Metallurgical and Materials Transactions,* Vol. 25b, Feb. 1994, pages 27–32 utilized an induction furnace to effect the separation of vanadium from so-called vanadiferous slag. However, there is no indication by Howard et al that their separation methodology and apparatus is capable of production of large commercial quantities or inequalities to be of commercial value and there is no mention of how their process could be used in plasma arc furnaces, such furnaces having applications in conjunction with other types of waste ashes.

OBJECTS OF THE INVENTION

It is an object of the invention to provide a method of efficiently, effectively and efficiently separating vanadium from vanadium containing ashes.

It is another object of the invention to provide an effective and efficient method of separating nickel from vanadium containing ashes that also typically contain significant amounts of nickel.

It is yet another object of the invention to provide a method capable of separating vanadium and nickel from waste ashes in plasma arc furnaces that are adapted for utilization in conjunction with multiple types of waste ashes.

Other objects and advantages of the invention will become apparent to those skilled in the art from the drawing, the detailed description of the invention, and the appended claims.

SUMMARY OF THE INVENTION

The invention lies primarily with a method of separating vanadium from vanadium containing waste ash including generating a high temperature thermal plasma and contacting the waste ash with the high temperature thermal plasma in the presence of oxygen, thereby forming a layer of iron from iron contained within said waste ash and a layer of slag from the waste ash on top of the iron layer. Then, vanadium is collected at an upper surface of the layer of molten iron and reacted with the oxygen to form vanadium oxides and combine with the layer of slag. Most of, but not all of, the layer of iron is removed, followed by adding aluminum and carbon to the layer of slag, stirring the layer of slag without addition of more oxygen and reducing or terminating power supplied to generate the high temperature thermal plasma. This causes the aluminum to replace the vanadium in the vanadium oxides and causes the carbon to remove oxygen from iron oxides in the remaining portion of the layer of iron, whereby vanadium and iron combine to form a ferro-vanadium alloy.

BRIEF DESCRIPTION OF THE DRAWING

The drawing shows a schematic view of a plasma arc thermal furnace that may be utilized in accordance with aspects of the invention.

DETAILED DESCRIPTION OF THE INVENTION

Figure 1:
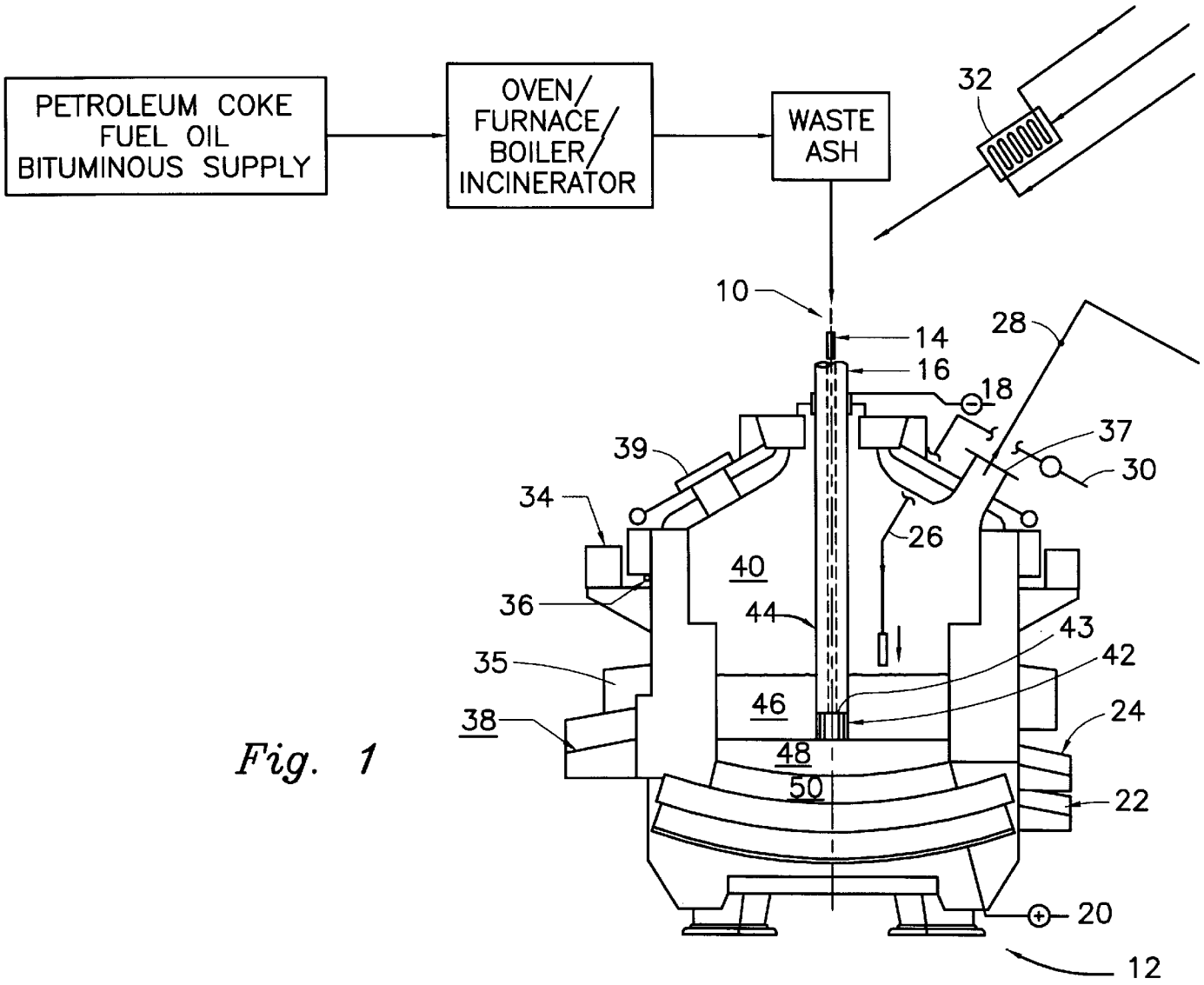

It will be appreciated that the following description is intended to refer to specific embodiments of the invention selected for illustration in the drawing and is not intended to define or limit the invention, other than in the appended claims.

Referring now to the drawing, preferred apparatus for separating vanadium and nickel from waste ash is shown. Waste ash is produced from a variety of materials such as petroleum coke, bituminous slurries, fuel oils and the like. These materials are first combusted, incinerated, burned or the like in accordance with well known methodology. The combustion process produces ash. The ash contains significant quantities of vanadium, typically in oxide form (monoxide, trioxide, pentoxide, etc.). The ash also typically contains significant quantities of nickel, also typically in oxide form.

The waste ash is formed by known methods into relatively small particles 10 having a diameter of up to about ⅝". This size can vary and is primarily guided by the requirements of DC plasma arc furnace 12. The particles are fed into furnace 12 through feed tube 14. Feed tube 14 is located within electrode 16 that extends downwardly into an interior chamber within furnace 12.

The specific configuration of furnace 12 is not especially critical and DC plasma arc furnaces of a number types are well known in the art. Additional preferred components of furnace 12 include a negative power source 18, a positive power source 20, a heel metal tap 22, a feed metal tap 24, an oxygen lance 26, a $NO_2$, $O_2$, CO, $CO_2$ and $H_2O$ pressure sensor 28, flow controller 30, plasma gas cooler 32, induction coil 34, water cooler 36, slag tap 38, off-gas outlet 37, supplemental feed port 39 and conductive bottom 50. It is important that furnace 12 have an additional induction coil 35. Induction coil 35 performs a stirring or mixing function without generating substantial quantities of heat. In fact, it is preferred that induction coil 35 generate almost no heat at all.

In operation, furnace 12 has two high temperature reaction zones. One is the general furnace atmosphere or freeboard zone 40, which may be at a temperature of about 2,800°–3,200° F., depending on the chosen operating conditions. The second zone is plasma zone 42 in which temperatures often approach about 25,000° to 30,000° F. or more. Chemically, furnace atmosphere or freeboard zone 40 can be controlled to be oxidizing, reducing or neutral. It operates at a higher temperature than most combustion based incinerators. However, it does not depend upon exothermic combustion reactions to maintain its operating temperature. Also important is that the volume of gases in furnace atmosphere 40 is not dominated by burner combustion products and the associated high volumeric flow rates of reactants. The system offers close control of off-gas composition and flow rate.

The main driving potential of furnace 12 is plasma zone 42, hereinafter sometimes referred to as a "high temperature thermal plasma." It is characterized by high viscosity, extremely high heat transfer rates, and molecular species that are predominantly ionized. The plasma is electrically neutral with substantially equal number of positive and negatively charged ions present. It is highly electrically conductive and, once formed, the plasma is stable. Chemically, large molecules are broken down into small fragments and ionized and the plasma incorporates simple monatomic and diatomic ions (one or two atom species). Typical reaction products upon cooling to furnace temperature are $N_2$, CO, HCl gas, HF gas, $H_2$, $P_2O_5$, $O_2$, and $CO_2$. Depending on the conditions present in furnace atmosphere 42, some oxides of nitrogen may form.

During operation, particles 10 fall through feed tube 14 downwardly toward a bottom portion 44 of electrode 16 and into the heating chamber of furnace 12. The exit 43 of lower portion 44 of electrode 16 is the location of plasma zone 42 which causes contact of particles 10 with plasma. Plasma zone 42 is surrounded by slag layer 46 which forms as a result of particle contact with the plasma zone. A layer of molten iron or iron heel 48 is also formed separately and lies underneath slag layer 46. Iron heel 48 rests on conductive bottom 50.

Vanadium has a low solubility in molten iron at about 0.1%. Thus, vanadium does not tend to remain in solution in the layer of molten iron. The vanadium rises by density difference, i.e., by liquation, to the upper surface of the layer of molten iron 48.

During the beginning of the operation, oxygen is introduced into furnace 12 by oxygen lance 26. Of course, this assists in heat generation but also provides a source of oxygen in slag 46 and iron heel 48. As a consequence, vanadium that accumulates or collects at the upper surface of iron heel 48 utilizes the sufficient oxygen partial pressure present in the slag layer to form vanadium monoxide and, subsequently, vanadium trioxide. The resulting vanadium oxides then pass into slag layer 46.

As previously described, nickel is also present in the waste ash. The nickel is more soluble in iron than vanadium and passes into molten iron layer 48 to form a molten nickel rich iron layer that can be tapped by way of heel metal tap 22 and cast into pigs. Such nickel rich iron is typically used in conjunction with stainless steel manufacture.

It is preferred that about 95% of molten iron layer 48 be removed by way of heel metal tap 22. To make up for the additional space created by removal of most of the layer of molten iron, electrode 16 is preferably lowered. Then, slag layer 46 is stirred, preferably by magnetic induction coil 35. Most preferably, magnetic induction coil 35 is substantially non-heat generating, since addition of more heat at this stage is not only not required, but undesirable. At the beginning of stirring, aluminum and carbon are added to slag layer 46. The amount of added aluminum is preferably three parts aluminum per one part of combined iron and vanadium. Similarly, preferably about 1 part carbon per three parts of iron and vanadium combined are added to molten slag layer 46.

At this point, the power source used to generate the high temperatures thermal plasma should be substantially reduced or terminated, but stirring should be maintained. Also, the supply of oxygen should be reduced and preferably terminated. The added aluminum displaces vanadium exothermically from the vanadium oxides and the added carbon acts as an oxygen getter to remove oxygen from oxides present in slag layer 46. Reducing or terminating the oxygen supply decreases the oxygen partial pressure in slag layer 46 and the power input is reduced or terminated to offset the high exotherm of the aluminum-vanadium oxides reaction.

The result is the production of vanadium metal and iron metal, which forms into a ferro-vanadium alloy. This alloy is diluted somewhat by the residual molten iron left from iron heel 48. The resulting ferro-vanadium alloy is preferably composed of about 30 wt % vanadium and 70 wt % iron.

The process of the invention is operating in batches and each batch should run about 90 minutes of operating time. Of course, this operational time per batch can vary depending on the specific construction aspects of furnace 12 and the specific components of the waste ashes utilized in the furnace.

Although this invention has been described in connection with specific forms thereof, it will be appreciated that a wide equivalents may be substituted for the specific elements described herein without departing from the spirit and scope of the invention as described in the appended claims.

What is claimed is:

1. A method of separating vanadium from waste ash containing vanadium and vanadium compounds, iron and iron compounds or nickel comprising:

generating a high temperature thermal plasma in the presence of oxygen;

contacting said waste ash with said high temperature thermal plasma, thereby forming a layer containing vanadium and vanadium compounds, iron and iron oxides from said waste ash and a slag layer on top of said layer;

causing vanadium and vanadium compounds in said layer to separate and collect at an upper surface of said layer and then react with said oxygen to form vanadium oxides and combine with said slag layer;

removing most of, but not all of, said layer;

stirring said slag layer without addition of more of said oxygen and adding aluminum and carbon to said slag layer;

reducing energy production of said high temperature thermal plasma;

generating vanadium metal by causing said aluminum to replace vanadium in said vanadium oxides;

generating iron metal by causing said carbon to remove oxygen from said iron oxides in said remaining portion of said layer; and combining said vanadium and iron metal to form a ferro-vanadium alloy.

2. The method defined in claim 1 wherein said ferro-vanadium alloy contains about 30 weight % vanadium and about 70 weight % iron.

3. The method defined in claim 1 wherein about 95% of said layer is removed.

4. The method defined in claim 1 wherein about 3 parts aluminum per 1 part of iron and vanadium are added to said slag layer.

5. The method defined in claim 1 wherein about 1 part carbon per 3 parts of iron and vanadium are added to said slag layer.

6. The method defined in claim 1 wherein said high temperature thermal plasma is generated in a plasma arc furnace.

7. The method defined in claim 6 wherein said stirring is performed by a magnetic induction coil positioned adjacent said slag layer.

8. The method defined in claim 7 wherein said magnetic induction coil is substantially non-heat generating.

9. The method defined in claim 1 wherein said high temperature thermal plasma is at a temperature of about 25,000°–30,000° F.

10. The method defined in claim 1 wherein said layer and said slag layer are maintained at a temperature of about 2,800°–3,200° F.

11. The method defined in claim 1 further comprising causing nickel contained in said waste ash to dissolve into said layer of iron to form a nickel rich layer of iron.

12. A method of separating vanadium from waste ash containing vanadium and vanadium compounds, iron and iron compounds comprising:

generating a high temperature thermal plasma in the presence of oxygen;

contacting said waste ash with said high temperature thermal plasma, thereby forming a layer containing vanadium and vanadium compounds, iron and iron oxides from said waste ash and a slag layer on top of said layer;

causing vanadium and vanadium compounds in said layer to separate and collect at an upper surface of said layer and then react with said oxygen to form vanadium oxides and combine with said slag layer;

removing most of, but not all of, said layer to form a remaining portion;

stirring said slag layer without addition of more of said oxygen and adding aluminum and carbon to said slag layer;

reducing or terminating power supplied to generate said high temperature thermal plasma; and causing said aluminum to replace vanadium in said vanadium oxides and causing said carbon to remove oxygen from said iron oxides in said remaining portion of said layer, whereby vanadium and iron combine to form a ferro-vanadium alloy.

13. A method of producing ferro-vanadium alloy comprising:

generating a high temperature thermal plasma in the presence of oxygen;

contacting waste ash containing vanadium and vanadium compounds, iron and iron compounds or nickel with said high temperature thermal plasma to form a layer of vanadium and vanadium compounds, iron and iron oxides and a slag layer on top of said iron layer;

causing vanadium and vanadium compounds in said layer to separate and collect at an upper surface of said layer and then react with said oxygen to form vanadium oxides and combine with said slag layer;

removing most of, but not all of, said layer to form a remaining portion;

stirring said slag layer without addition of more of said oxygen and adding aluminum and carbon to said slag layer;

reducing energy production of said high temperature thermal plasma;

generating vanadium metal by causing said aluminum to replace vanadium in said vanadium oxides;

generating iron metal by causing said carbon to remove oxygen from said iron oxides in the remaining portion of said layer; and combining said vanadium and iron metal to form said ferro-vanadium alloy.

14. The method defined in claim 13 wherein said ferro-vanadium alloy contains about 30 weight % vanadium and about 70 weight % iron.

15. The method defined in claim 13 wherein about 95% of said layer is removed.

16. The method defined in claim 13 wherein about 3 parts aluminum per 1 part of iron and vanadium are added to said slag layer.

17. The method defined in claim 13 wherein about 1 part carbon per 3 parts of iron and vanadium are added to said slag layer.

18. The method defined in claim 13 wherein said stirring is performed by a magnetic induction coil positioned adjacent said slag layer.

19. The method defined in claim 13 wherein said magnetic induction coil is substantially non-heat generating.

20. The method defined in claim 13 further comprising causing nickel contained in said waste ash to dissolve into said layer to form a nickel rich layer of iron.

* * * * *